US008002134B2

(12) United States Patent
Whyte

(10) Patent No.: US 8,002,134 B2
(45) Date of Patent: Aug. 23, 2011

(54) DOORLESS INTERMODAL CARGO CONTAINER

(75) Inventor: Garry R. Whyte, Aurora, OR (US)

(73) Assignee: Cakeboxx, LLC, Aurora, OR (US)

( * ) Notice: Subject to any disclaimer, the term of this patent is extended or adjusted under 35 U.S.C. 154(b) by 683 days.

(21) Appl. No.: 11/736,873

(22) Filed: Apr. 18, 2007

(65) Prior Publication Data

US 2007/0246466 A1 Oct. 25, 2007

Related U.S. Application Data

(60) Provisional application No. 60/793,418, filed on Apr. 20, 2006.

(51) Int. Cl.
*B65D 88/00* (2006.01)
*B65D 8/14* (2006.01)
*B65D 45/16* (2006.01)

(52) U.S. Cl. ..... 220/1.6; 220/326; 220/7

(58) Field of Classification Search ..... 220/4.01, 220/200, 617, 615, 622, 610, 693, 692, 682; 292/146, 137; 206/600, 386; 217/59, 61, 217/60 R, 62, 57, 56, 43 A, 45, 43 R, 36, 217/12 A, 13, 12 R, 5; D9/414, 443, 435, D9/434; 70/266; *B65D 6/16, 6/00*
See application file for complete search history.

(56) References Cited

U.S. PATENT DOCUMENTS 2,556,418 A * 6/1951 Del Mar ..... 62/62
2,920,781 A * 1/1960 Weber et al. ..... 217/12 R
3,042,227 A 7/1962 Tantlinger
3,088,619 A * 5/1963 Boucher ..... 220/1.5
3,261,493 A * 7/1966 Smith ..... 217/65
3,374,915 A * 3/1968 Verhein et al. ..... 220/4.28
3,529,741 A * 9/1970 Tabron et al. ..... 220/7
3,568,912 A 3/1971 de Simas
3,584,757 A * 6/1971 Blaisdell ..... 220/4.28
3,602,376 A 8/1971 DePiano
3,760,970 A * 9/1973 Lutz ..... 220/4.28
3,797,691 A * 3/1974 Williams, Jr. ..... 220/1.5
3,853,238 A * 12/1974 Luisada et al. ..... 220/1.5
3,872,555 A 3/1975 Link et al.
3,908,852 A * 9/1975 Ricobene et al. ..... 206/550
4,010,990 A 3/1977 Rowley et al.
4,015,715 A 4/1977 Kelf
4,120,415 A * 10/1978 Hopkins et al. ..... 220/323
4,355,732 A * 10/1982 Nessfield ..... 220/1.5
4,360,115 A 11/1982 Saunders
4,416,385 A * 11/1983 Clare et al. ..... 220/1.5
4,546,896 A 10/1985 Reid et al.
4,809,851 A * 3/1989 Oestreich et al. ..... 206/599
4,936,451 A 6/1990 Shuert
(Continued)

*Primary Examiner* — Anthony Stashick
*Assistant Examiner* — Robert J Hicks
(74) *Attorney, Agent, or Firm* — Mark Terry

(57) ABSTRACT

In one embodiment, an intermodal cargo container includes a lid section having a rectangular box with an open bottom portion. A floor unit has a channel portion arranged around a periphery, and the channel portion receives a bottom edge of the lid section. Locking mechanisms are arranged along an edge of the lid section to couple the lid section to plural rungs that extend across the channel portion. The sliding lock mechanism includes engagement tabs that engage associated rungs extending between two walls of the channel portion. A sealing portion is provided within the channel so as to provide a fluid-tight seal when the lid section is coupled to the floor unit. A powered actuator can assist in moving the lock mechanism. A spring assembly at a corner of the floor unit provides a spring tension to the sliding lock mechanism.

21 Claims, 22 Drawing Sheets

U.S. PATENT DOCUMENTS

| | | | | |
|---|---|---|---|---|
| 4,983,089 | A * | 1/1991 | Rose | 414/276 |
| 5,111,950 | A | 5/1992 | Wylenzek | |
| 5,122,025 | A | 6/1992 | Glomski | |
| 5,671,854 | A | 9/1997 | Thomas | |
| 5,722,328 | A * | 3/1998 | Darby | 108/55.1 |
| 6,112,929 | A | 9/2000 | Ota et al. | |
| 6,598,540 | B2 | 7/2003 | Austin et al. | |
| 6,752,285 | B1 | 6/2004 | Scalf | |
| 6,811,048 | B2 | 11/2004 | Lau et al. | |
| 7,093,731 | B2 | 8/2006 | Karpisek et al. | |
| 2003/0024926 | A1 | 2/2003 | Karpisek | |
| 2004/0124647 | A1 | 7/2004 | Hase et al. | |
| 2004/0200832 | A1 * | 10/2004 | Moon et al. | 220/4.28 |

* cited by examiner

DOORLESS INTERMODAL CARGO CONTAINER

CROSS REFERENCE TO RELATED APPLICATIONS

This application claims benefit under 35 USC 119(e) to Provisional application 60/793,418 filed on Apr. 19, 2006, the entire contents of which are incorporated herein by reference.

BACKGROUND

This application relates to the intermodal shipping industry, and more particularly to containerization using intermodal shipping containers. Even more particularly, this application provides an improvement to homeland security by making inspection of containerized cargo faster, easier, and more reliable than conventional techniques.

Containerization is a system of intermodal freight transport cargo transport using standard ISO containers (known as "Shipping Containers" or "Isotainers") that can be loaded and sealed intact onto container ships, railroad cars, planes, and trucks.

Intermodal shipping containers generally are hollow rectangular cubes which may vary in size from 20×8.5×8 feet, to 40, 45, and 50 foot lengths, which may rise in height to 9.5 feet. These containers generally have standardized dimensions and corner posts in accordance with industry standards applicable to intermodal shipping containers.

There are five common standard lengths, 20-ft (6.1 m), 40-ft (12.2 m), 45-ft (13.7 m), 48-ft (14.6 m), and 53-ft (16.2 m). United States domestic standard containers are generally 48-ft and 53-ft (rail and truck). Container capacity is measured in twenty-foot equivalent units (TEU). A twenty-foot equivalent unit is a measure of containerized cargo capacity equal to one standard 20 ft (length)×8 ft (width)×8 ft 6 in (height) container. In metric units this is 6.10 m (length)×2.44 m (width)×2.59 m (height), or approximately 38.5 $m^3$. These sell at about US$2,500 in China, the biggest manufacturer. Most containers today are of the 40-ft (12.2 m) variety and are known as 40-foot containers.

The use of US measurements to describe container size, despite the fact the rest of the world uses the metric system, reflects the fact that US shipping companies played a major part in the development of containers. The overwhelming need to have a standard size for containers, in order that they fit all ships, cranes, and trucks, and the length of time that the current container sizes have been in use, makes changing to an even metric size impractical.

Access to the interior of an intermodal shipping container has conventionally been limited to a door or doors on one end of the container. This conventional arrangement has made it difficult to load cargo of certain shapes, and has also made security inspections and physical access to the cargo at ports of entry problematic because access to the first-loaded cargo at the end of the container away from the door is generally difficult. In addition, the conventional door arrangement has resulted in a certain amount of undesirable pilferage.

Further, the presence of doors on one end of the container results in a structural weakening of the container, thus limiting the number of containers that can safely be vertically stacked, as well as limiting access for offloading of cargo from the container.

What is needed is a container configured to facilitate security inspection of cargo contained within the container. What is further needed is a cargo container that allows relatively easy physical access to cargo contained therein to reduce the time and effort of loading and unloading the container. What is still further needed is an intermodal cargo container without conventional doors that constrains or prohibits unauthorized access to the contents of the container, and which provides increased structural integrity and physical security.

SUMMARY

The cargo container of this disclosure, marketed as "CakeBoxx"™, may have the same external dimensions as common ISO standard intermodal shipping containers. They are designed to fit into the system without any adjustments and perform the expected functions without changes in process or policy. They are designed to fit into the existing intermodal shipping system without any adjustments and perform the expected functions without changes in process or policy. Thus, the container of this disclosure has all the structural strength of ordinary containers, with increased compression load resistance, especially where the door hinges would normally be competing with the load bearing column for the limited available space.

The container of this disclosure may be scaled up or down and can come in any length, height or width that would be functional and desirable within the global intermodal shipping system. However, the net internal ("usable") volume of a 40' container of this disclosure exceeds the net internal volume of a conventional 40' container because there is no need to reserve empty space above the load so that it can be lifted, for example, by a forklift. The container of this disclosure increases the net internal capacity by being able to be loaded from the side with wide, full span pallets loaded slightly more than 8 feet high, rather than from a more restrictive end through a door. Further, when closed, an embodiment of the container may be made impervious to pilferage, water, moisture, and light.

As a consequence of the above, intermodal shipping containers of this disclosure are efficient, secure and convenient, and are desirable from the standpoint of increasing the ability to conduct efficient and timely security inspections at ports of entry, for example.

In one embodiment, the container of this disclosure is a mechanically simple device with few moving parts and, when closed, does not readily reveal that there are any moving parts, doors, latches, or even any interior access. When opened, the container floor is completely accessible from all sides, and horizontal tubes inside a gutter portion are the "rungs" that comprise attachment points for the lower section. The corner posts may be configured to have permanent "twist locks" on them that both guide the descent of the top "canopy" and, when closed, rotate to form redundant security latches and direct line of tension connections.

In one embodiment, an intermodal cargo container includes a lid section; a floor unit comprising a channel portion arranged around a periphery thereof, wherein the channel portion is arranged to receive a bottom edge portion of the lid section; and a sliding lock mechanism arranged to slidingly couple the lid section to plural rungs connected to and extending across the channel portion.

In another embodiment, an intermodal cargo container includes a lid section comprising a rectangular box having an open bottom portion; a floor unit comprising a channel portion arranged around a periphery thereof, wherein the channel portion is arranged to receive a bottom edge portion of the lid section; plural sliding locking mechanisms arranged along an open edge of the lid section to slidingly couple the lid section to plural rungs connected to and extending across the channel portion, wherein the sliding lock mechanism comprises engagement tabs that engage associated rungs extending between two walls of the channel portion; corner boxes arranged at each corner of the floor unit and at corners of an upper portion of the lid section; a sealing portion arranged within the channel portion, wherein the sealing portion provides a fluid-tight seal when the lid section is coupled to the floor unit; an actuator arranged to mechanically assist in moving the sliding lock mechanism in responsive to an operator command; a gooseneck cavity portion arranged at each end of the container; and a spring assembly arranged at a corner of the floor unit so as to provide a spring tension to the sliding lock mechanism.

In other aspects, the container may be lined with insulating material, or with food grade plastic film to allow raw foodstuffs, e.g., corn or grain, to be shipped. In additional aspects, at least the floor of the container may have slots or holes to allow the free flow of air into the container while maintaining cargo integrity, depending on the shipping need.

BRIEF DESCRIPTION OF THE DRAWINGS

FIG. 1 illustrates a perspective view of a closed intermodal shipping container of this disclosure. Typically, both ends of the container are alike or similar;

DETAILED DESCRIPTION

In one embodiment, the container is a relatively simple device requiring few moving parts and, when closed, the container is outwardly configured so that it is not readily apparent that there are any moving parts, doors, latches, or even any interior access.

Figure 1:
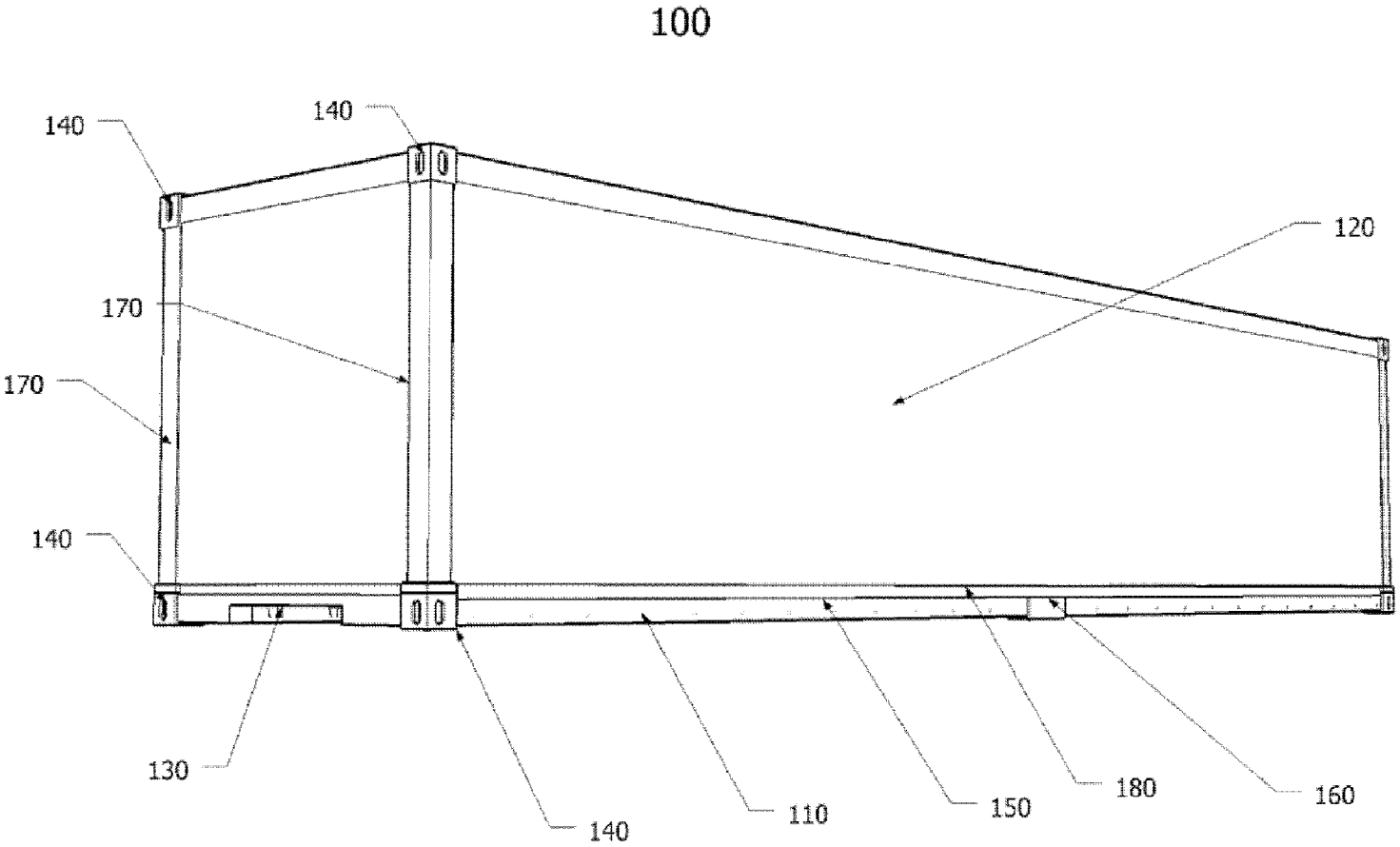

In FIG. 1, Intermodal Shipping Container 100 ("container") is illustrated in an exterior perspective view, and is seen to comprise floor support frame 110; upper section or canopy 120; gooseneck area or "tunnel" 130; ISO corner box assemblies 140; separation point or plane 150 used as a reference plane to illustrate the separation of canopy 120 from floor support frame 110; center span assembly 160; corner columns 170; and latch housing 180, generally joined to canopy 120 by welding, for example.

Figure 2:
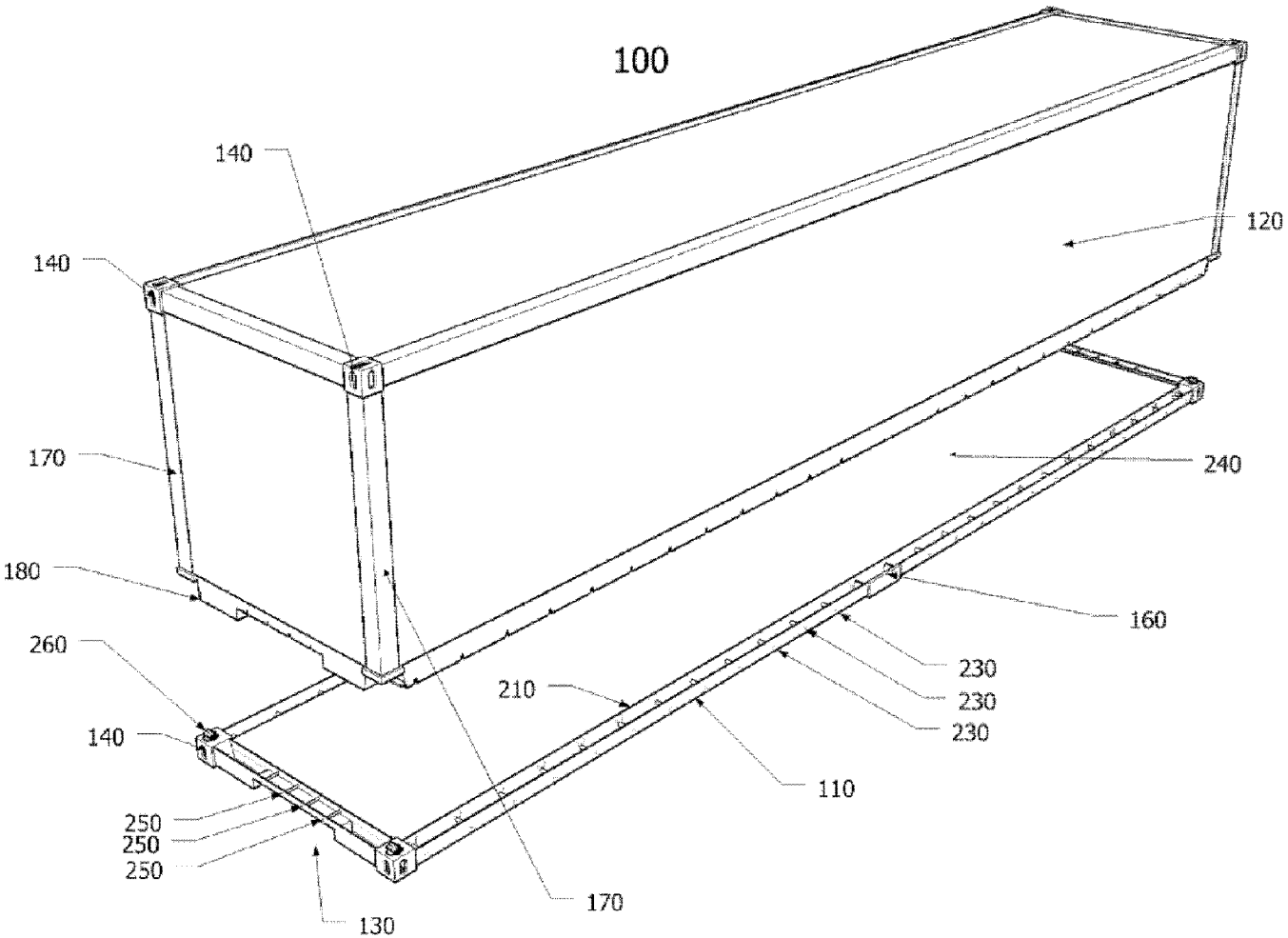
FIG. 2 depicts two sections two sections of the container vertically separated (approximately 4 feet), with a "gutter" running around the floor's perimeter being visible on the bottom section.

In the expanded perspective view of FIG. 2, the above elements are illustrated along with further details of floor support frame 110 and latch housing 180, as well as the interior of container 100. Floor support frame 110 includes perimeter channel or "gutter" 210 around the periphery of frame 110 and floor 240. Channel 210 may included a rubberized or other type of sealing material therein (not shown) which can provide a liquid and/or airtight seal between the interior of container 100 and the external environment.

The frame perimeter comprises channel 210 that may be of a convenient width and height, e.g., 5.5 inches±1.5" on either axis. Perimeter channel rungs or horizontal tubes 230 span channel 210 along both long sides of container 100. End rungs 250 span channel 210 along both ends of container 100 above gooseneck area 130. Floor or deck 240 is attached to frame 110 to provide a surface on which cargo may be arranged. Floor 240 may be a solid material such as wood, metal, or synthetic material, e.g., ECOBoard®. Alternatively, floor 240 may comprise a grating having slots or other openings such as slotted boards to allow fresh air to flow into and out of container 100, and which may be desirable for the secure shipment of fresh fruits and vegetables, for example.

FIG. 2 illustrates that floor 240 is completely accessible from all sides for loading or unloading when container 100 is opened. In FIG. 2, the upper and lower sections are vertically separated by approximately 4 feet, and gutter 210 running around the perimeter of floor 240 is visible.

Horizontal tubes 230 inside gutter 210 are the "rungs" that comprise the attachment points for the lower section of container 100. Further, corner posts 140 have permanent "twist locks" on them that both guide the descent of the top canopy 120 and, when closed, rotate to form redundant security latches and direct tensioned connections that secure canopy 120 to support frame 110.

Figure 3:
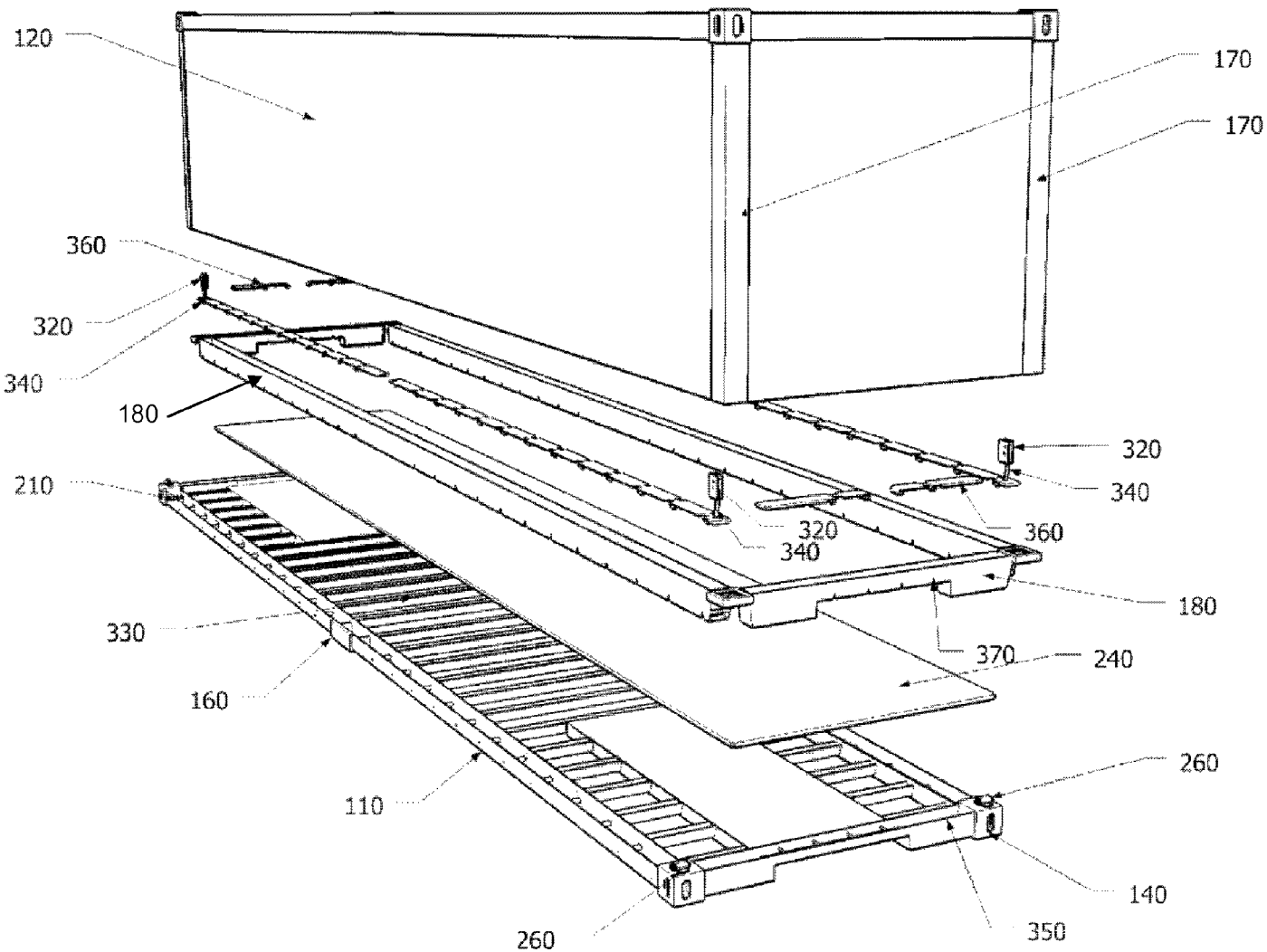
FIG. 3 illustrates five main sub-assemblies of the container of this disclosure in a vertically exploded view.
Figure 4:
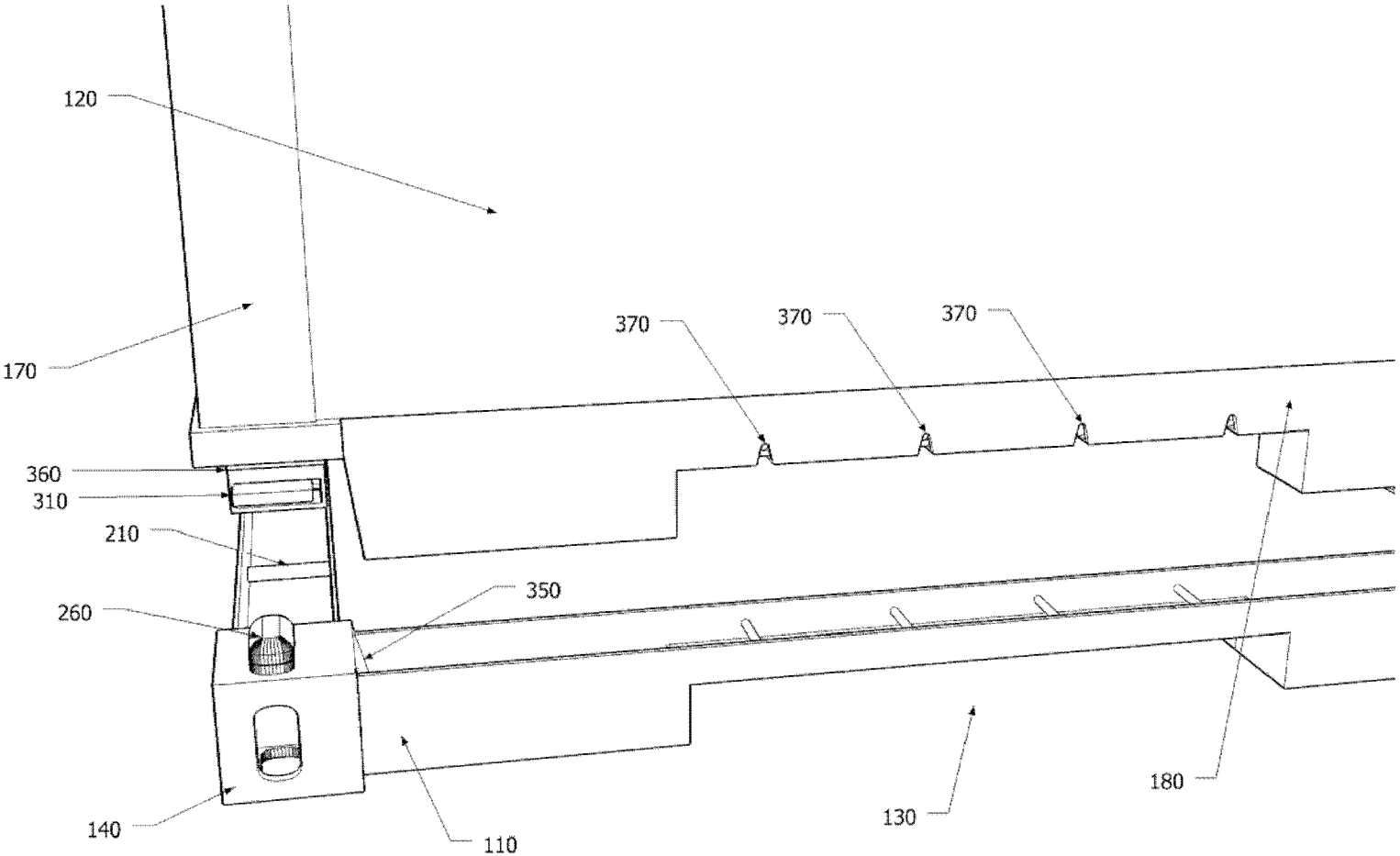
FIG. 4 provides a close-up view of fastening together of the two main assemblies when the top section is lowered into the perimeter gutter of the bottom section.

The five main sub-assemblies of container 100 are illustrated in the vertically exploded view of FIG. 3. These include frame 110, made of steel or other suitable material, for example, that may be supportably connected to floor 240. Latch housing 180 captures side latch sections 310 and end latch sections 360 so as to allow only one axis of back-and-forth sliding motion when interconnected with spring assembly 320 and spring 340. Latch housing 180 may be connected to canopy 120 by welded joints, for example. Cross-bracing 330 is connected across the width of frame 110 to provide additional support for floor 240 and to stiffen container against torque and other stresses, and may be made of steel or other suitable materials, for example.

Spring assemblies 320 contain associated springs 340 that intersect sliding latch sections 310. These are the mountings and springs that apply outward pressure to the sliding latch sections 310 and, when container 100 is closed, springs 340 remain engaged with rungs 230 and 250 of channel 210.

In one embodiment, upper section 120 could be the top seven or more feet of an ordinary shipping container, except for corner columns 170, which may be reinforced for additional strength.

The fastening together of the two main assemblies, i.e., canopy 120—latch housing 180 together with floor 240—floor support frame 110, is accomplished by lowering top section 120 into perimeter gutter 210 of bottom section 110, which causes sliding latch sections 310 and 360 to initially move out of the way, then latch onto rungs 230 and 250.

In operation, and when canopy 120 is lowered onto the lower section, sliding latches 310 and 360 strike the sloped sides 350 of gutters 210 which are sloped sides of the corner casting boxes 140. This causes latch sections 310 to slide sideways far enough that curved engagement tabs or "claws" 510 in FIGS. 5, and 6 allow rungs 230 or 250 from the lower section to settle into the cutout section of latch housing 180, and to rest on cutout or notched section 370.

Figure 6:
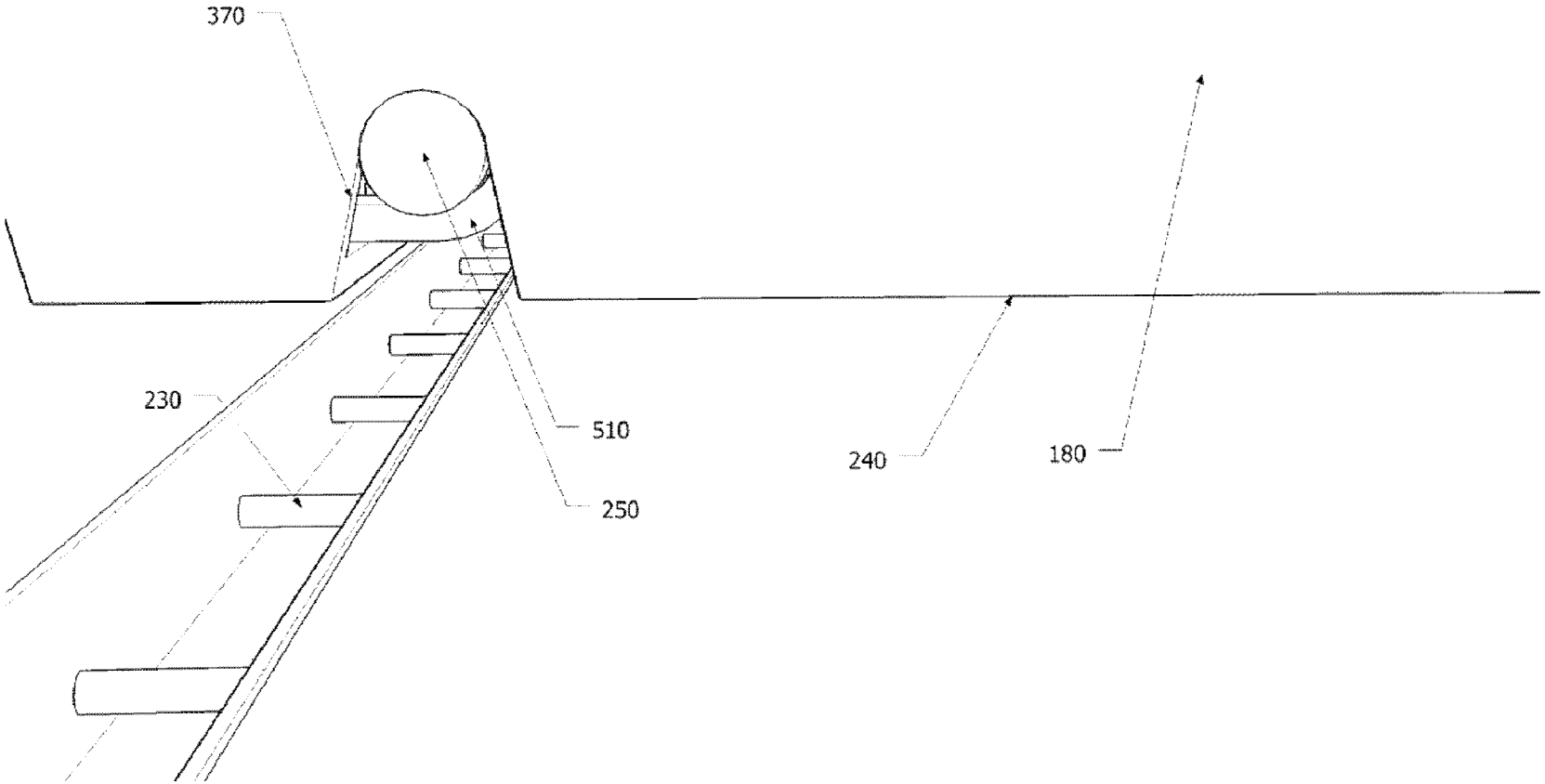
FIG. 6 depicts a close-up view of a rung captured by a sliding latch, with the gutter wall removed for clarity.
Figure 18:
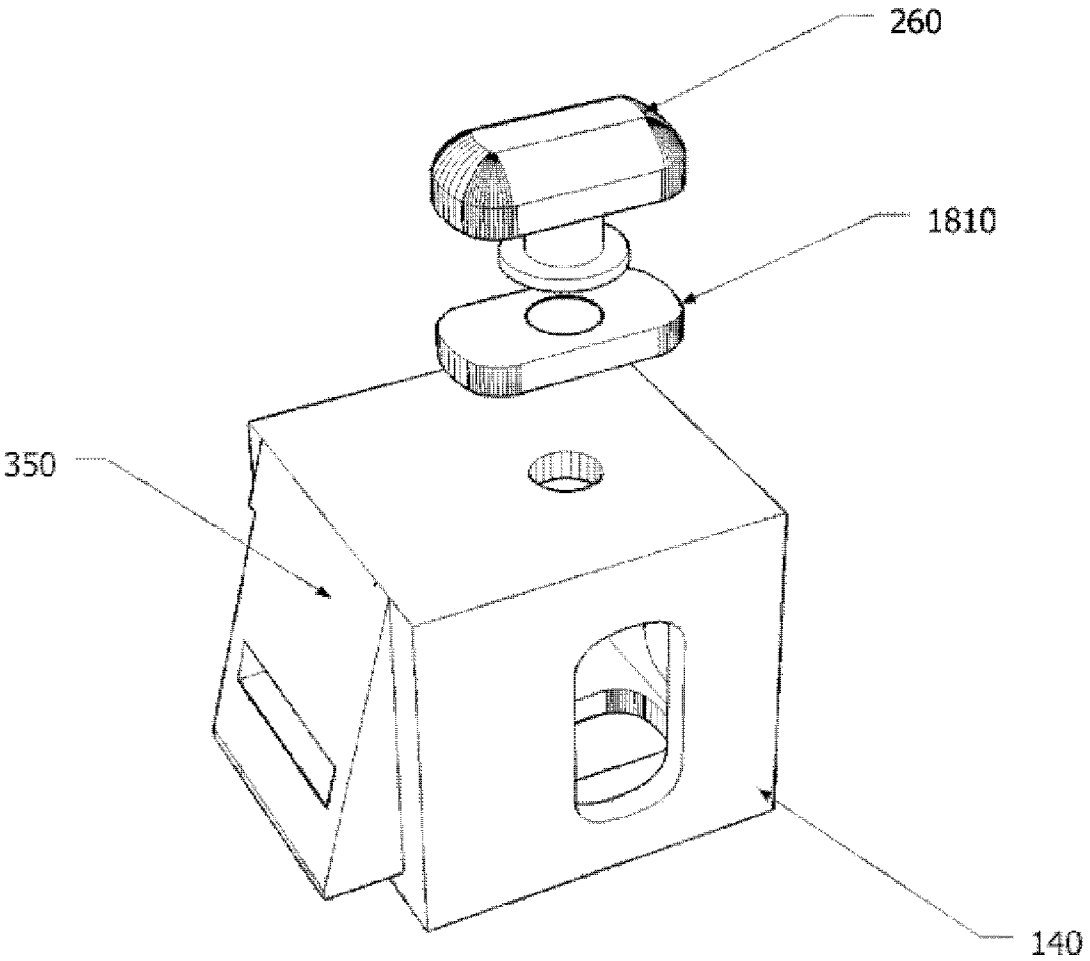
FIG. 18 provides an exploded view of an exemplary corner casting.

As the upper section is lowered to its resting position, twist-locks 260 will come into alignment with hole 810 (see FIG. 8) in corner post 140, as the previously mentioned spring tension will force sliding latches 310 and 360 outwards into the hole on face 350 in FIG. 18, thus capturing the corner casting and all the rungs in the lower frame gutters as depicted in FIG. 6. In one embodiment, there may be 64 such claws 510 and rungs 230/250 within channel 210 of frame 110, around the perimeter of container 100.

Figure 5:
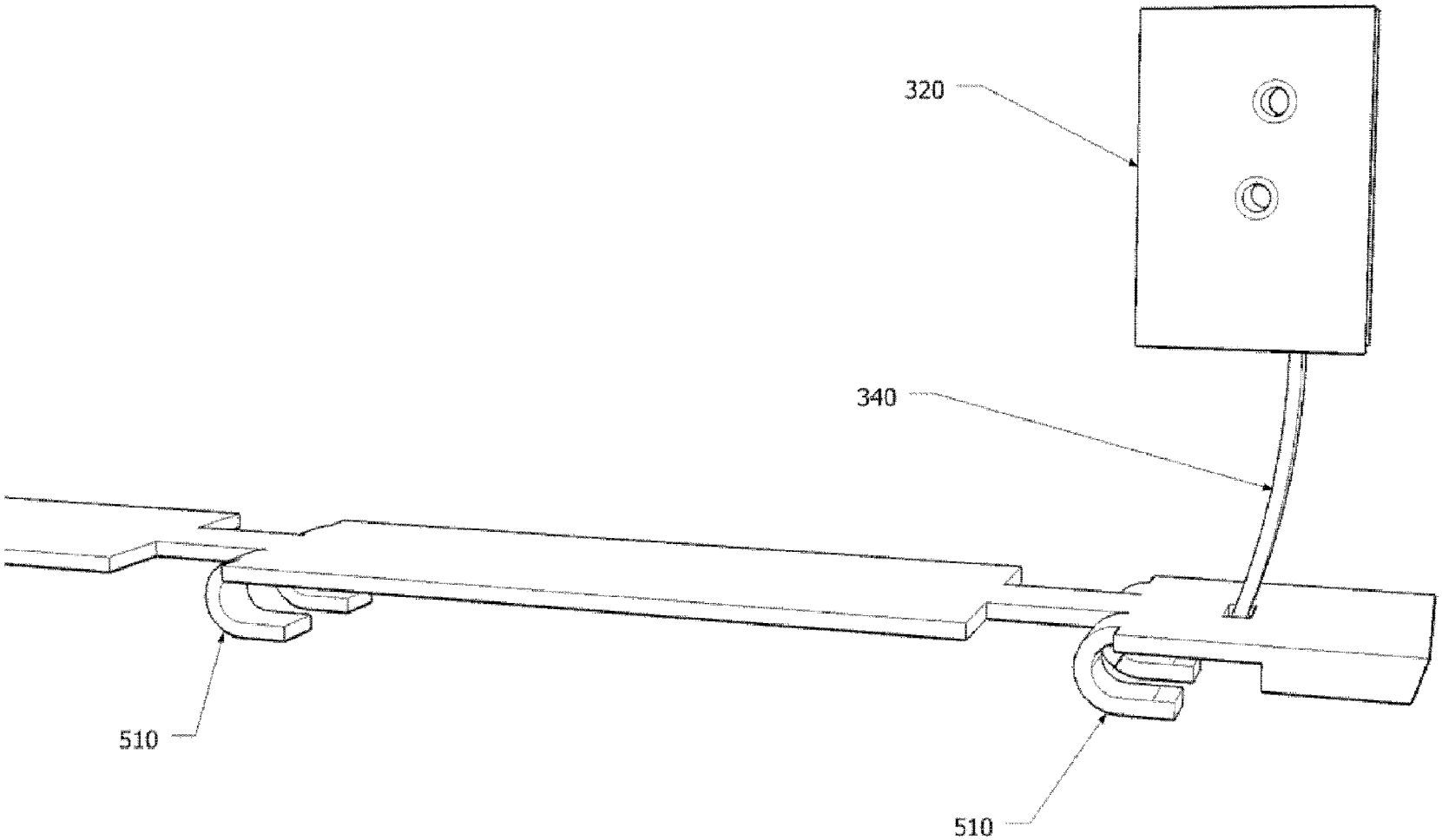
FIG. 5 illustrates a sliding latch.

The ends of container 100 may each have four short sections of the "sliding latches" 410 as shown in FIG. 5, and the sides of container 100 may each have two much longer sections. (See page 11.) All 12 pieces release with inward motion and capture with outward motion.

FIG. 6 illustrates a close-up of a captured rung 250, with the gutter wall removed to aid in exposition. Other perimeter rungs 230 are visible below, in their normal positions.

Figure 7:
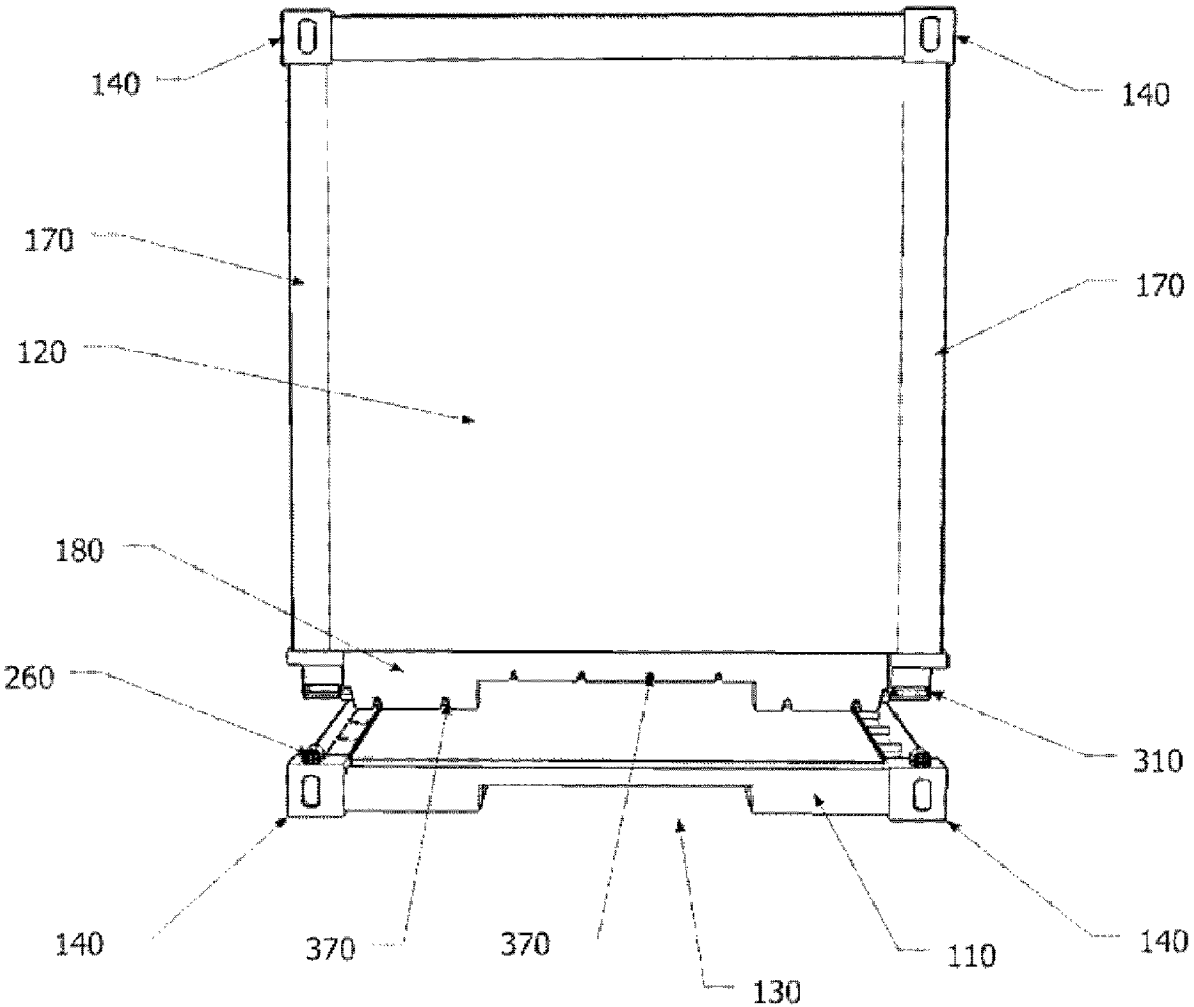
FIG. 7 is an end-view of a slightly opened container with the goose-neck tunnel.

FIG. 7 provides an end view of a slightly opened container 100 with a goose neck tunnel 130 clearly visible. Unlike conventional containers, both ends of container 100 may have such tunnels 130, thus eliminating the need for conventional "north-south" pre-alignment of containers when changing modes of transportation.

Figure 8:
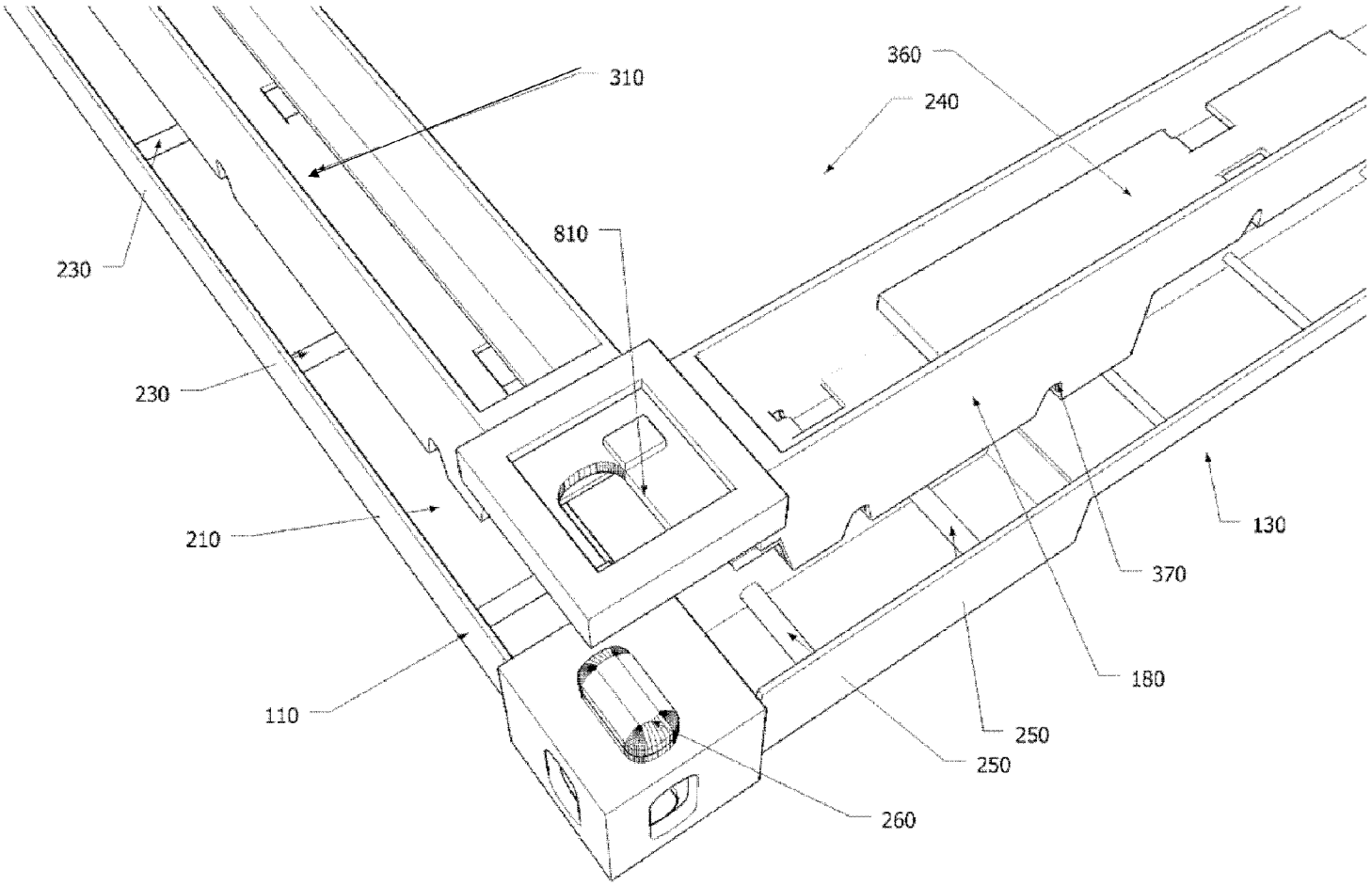
FIG. 8 provides a detail view of the interior of a corner post assembly including a corner post twist lock pin.

Corner post twist locks 260 act as guides, but they can then be turned to lock container 100 shut. All conventionally appropriate seals and locks may be attached either at one or more of twist locks 260, or near spring assemblies 320. A detail of the interior of the corner post assembly is shown in FIG. 8. When the upper and lower sections are mated, twist lock 260 may be rotated as seen in FIG. 9.

Corner twist locks 260 are somewhat redundant fasteners in some respects, and may not be completely necessary to the functional latching together of the upper and lower sections of container 100. But, when used, their inaccessibility and strength will make it very difficult to illicitly intrude into a container interior, and nearly impossible to do so without leaving dramatic, indelible evidence of such intrusion.

Figure 9:
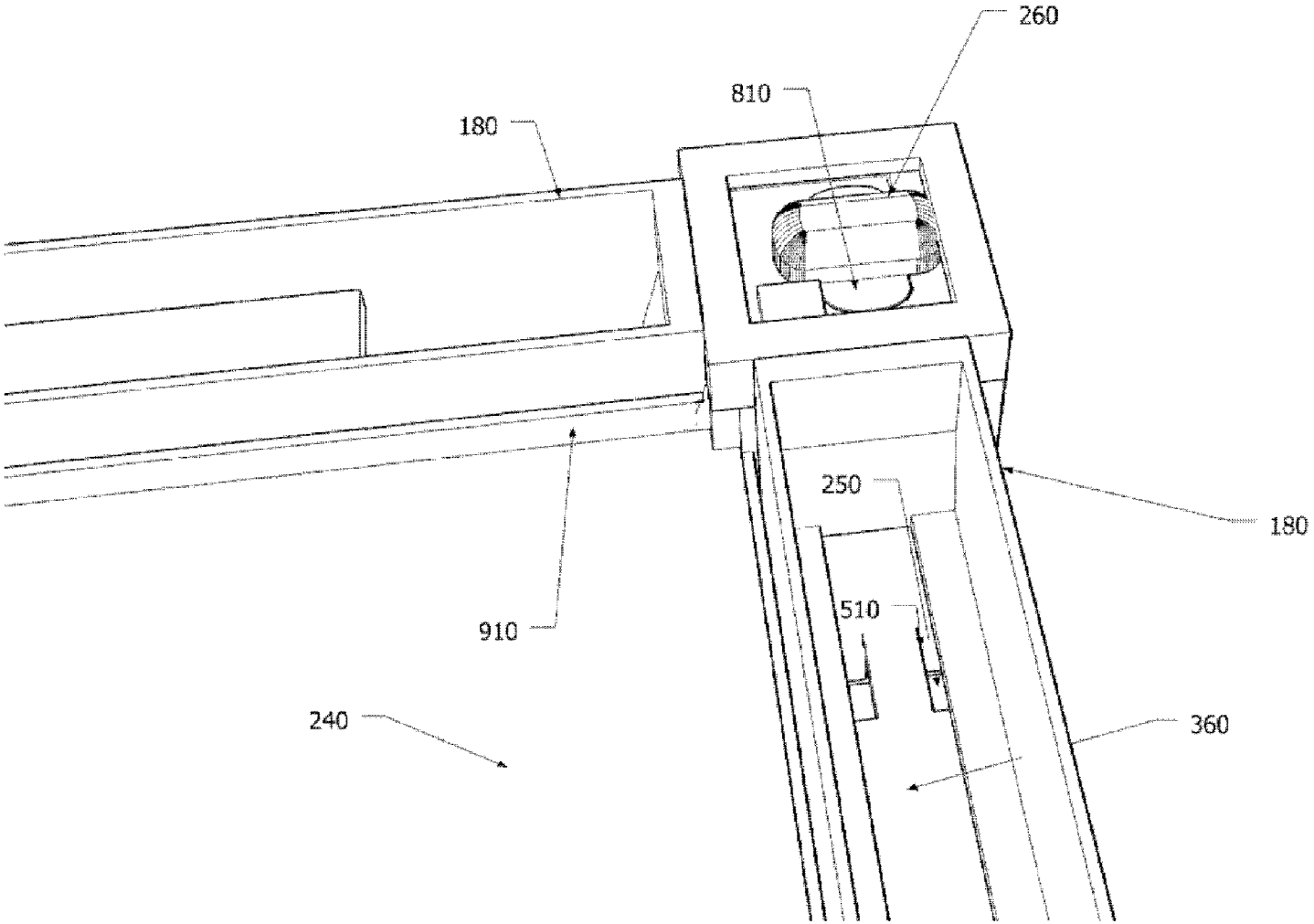
FIG. 9 provides a second detailed view of the interior of a corner post assembly showing the corner post twist lock pin in a rotated position used when the upper and lower sections are mated.
Figure 10:
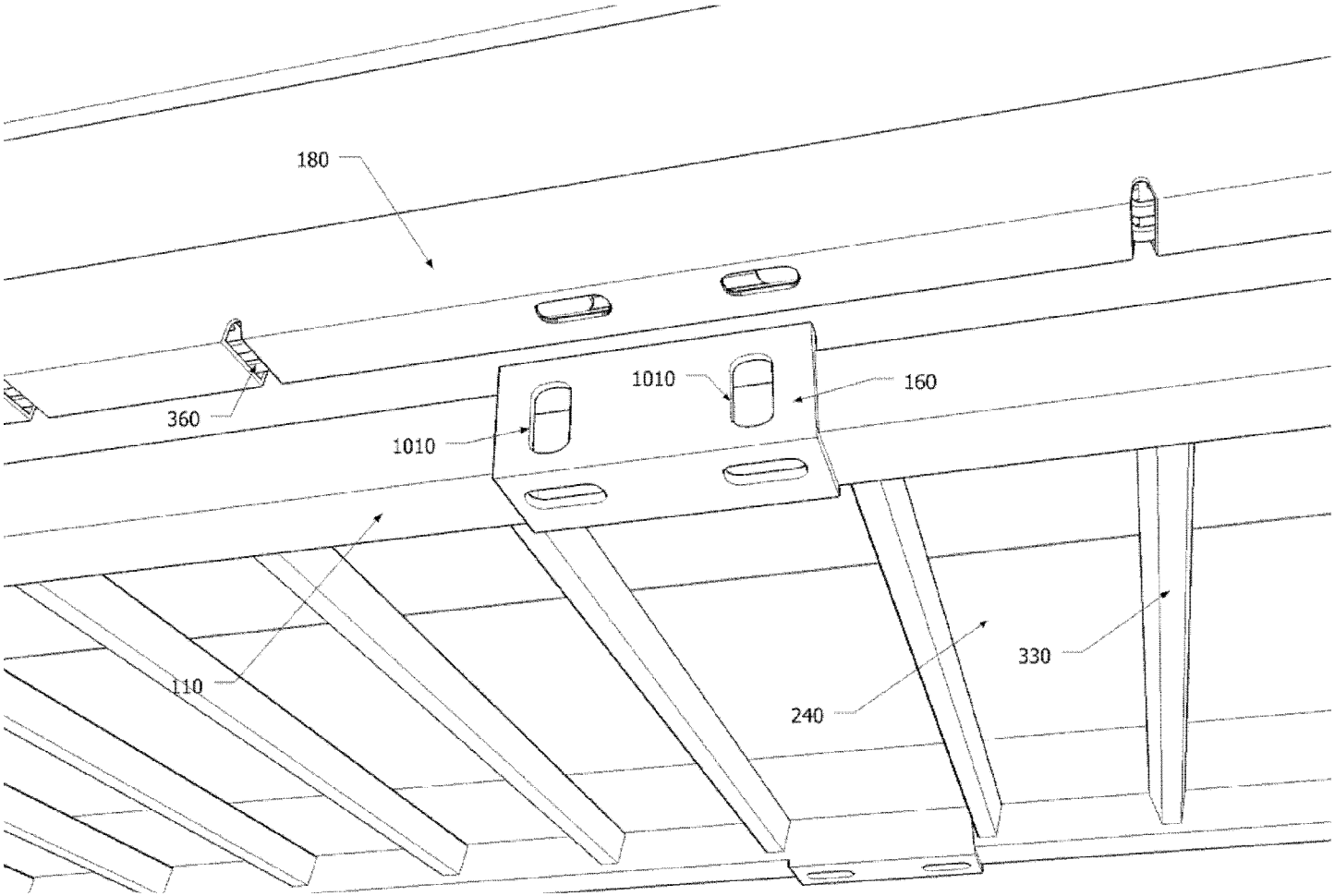
FIG. 10 provides a view of the center-span "ISO casting" where mechanical release action is accomplished.
Figure 11:
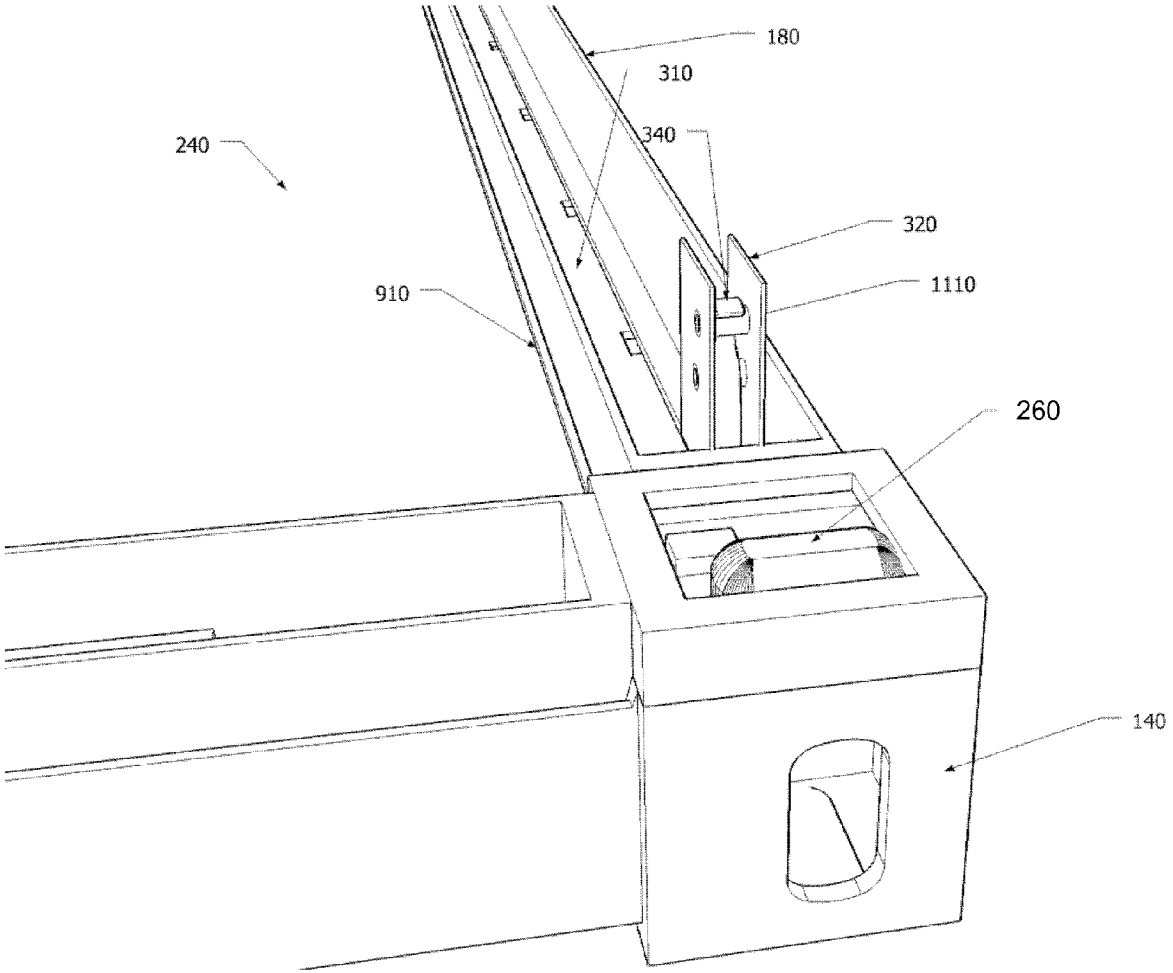
FIG. 11 provides a perspective view of the sliding latch bar springs and corner "twist-locks" in the normal "closed" position.
Figure 12:
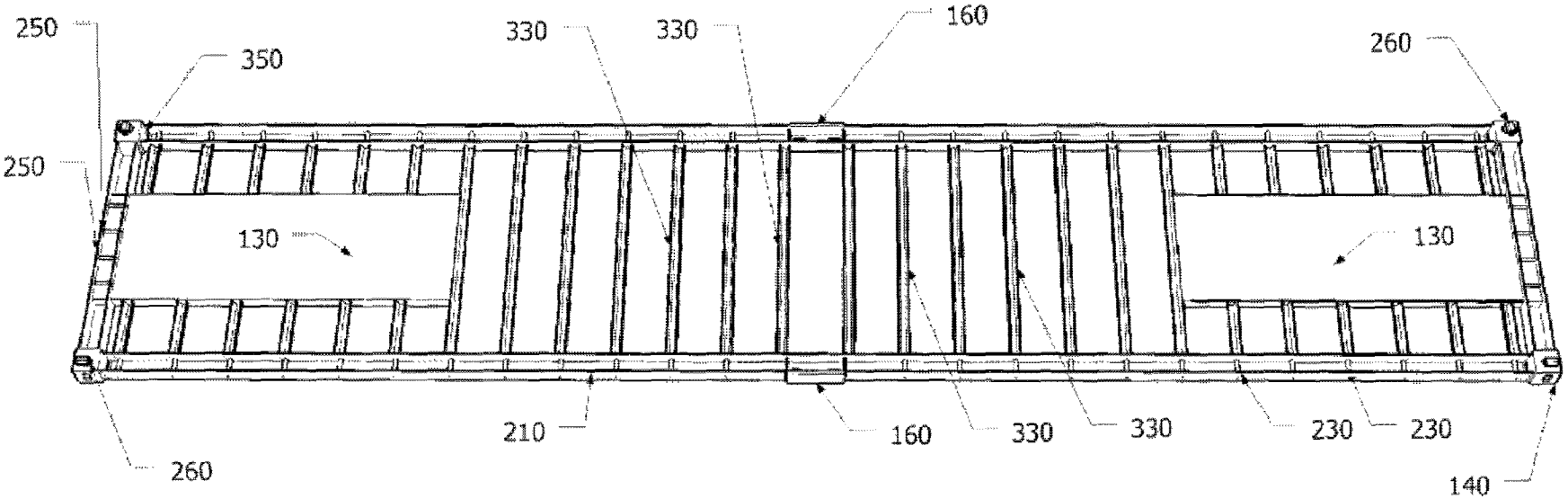
FIG. 12 is illustrative of a bottom frame in an embodiment of this disclosure.
Figure 13:
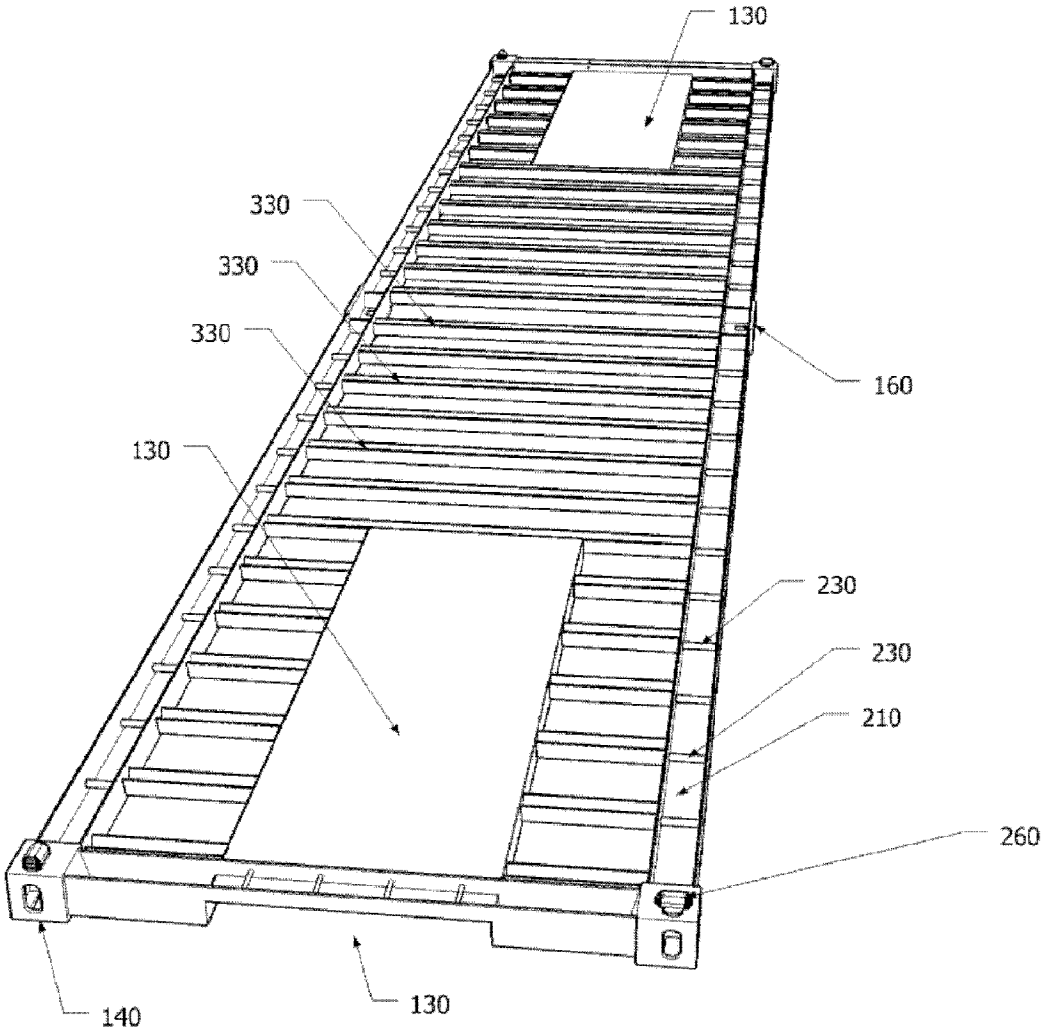
FIG. 13 illustrates an end view of the frame of FIG. 12.
Figure 14:
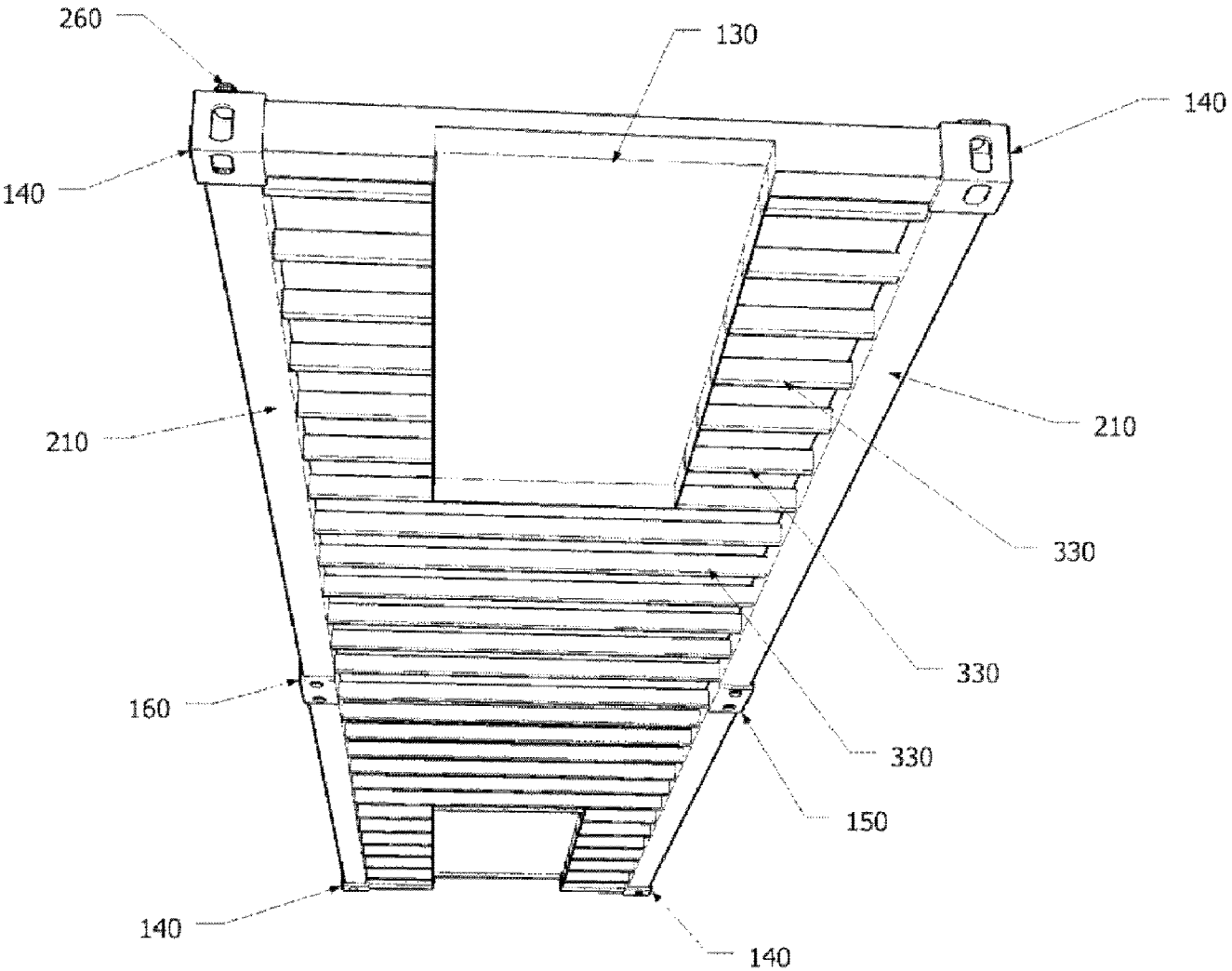
FIG. 14 illustrates a bottom view of the frame of FIG. 12 showing both goose-neck tunnels.
Figure 15:
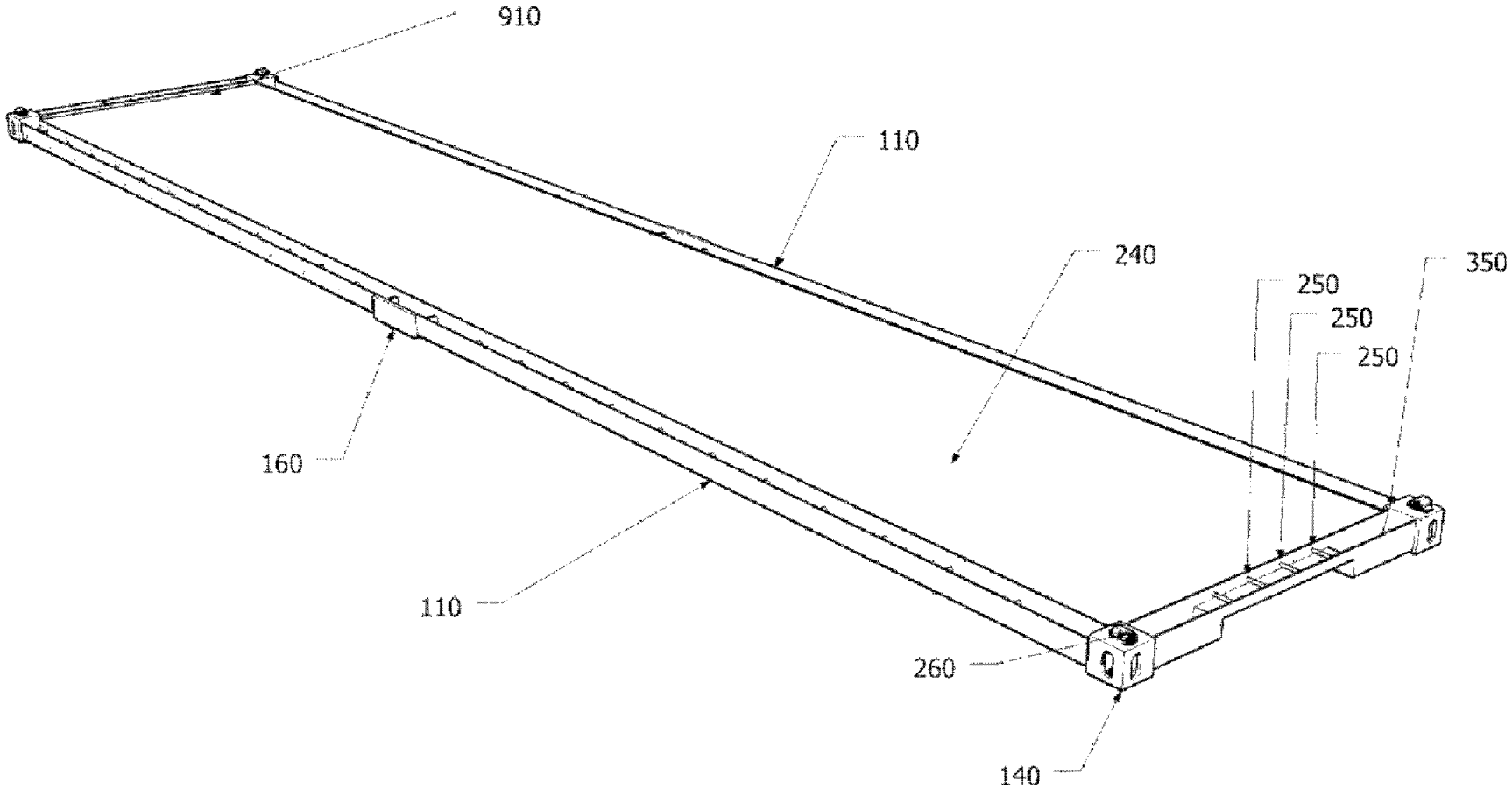
FIG. 15 illustrates a bare platform of the container ready for loading.
Figure 16:
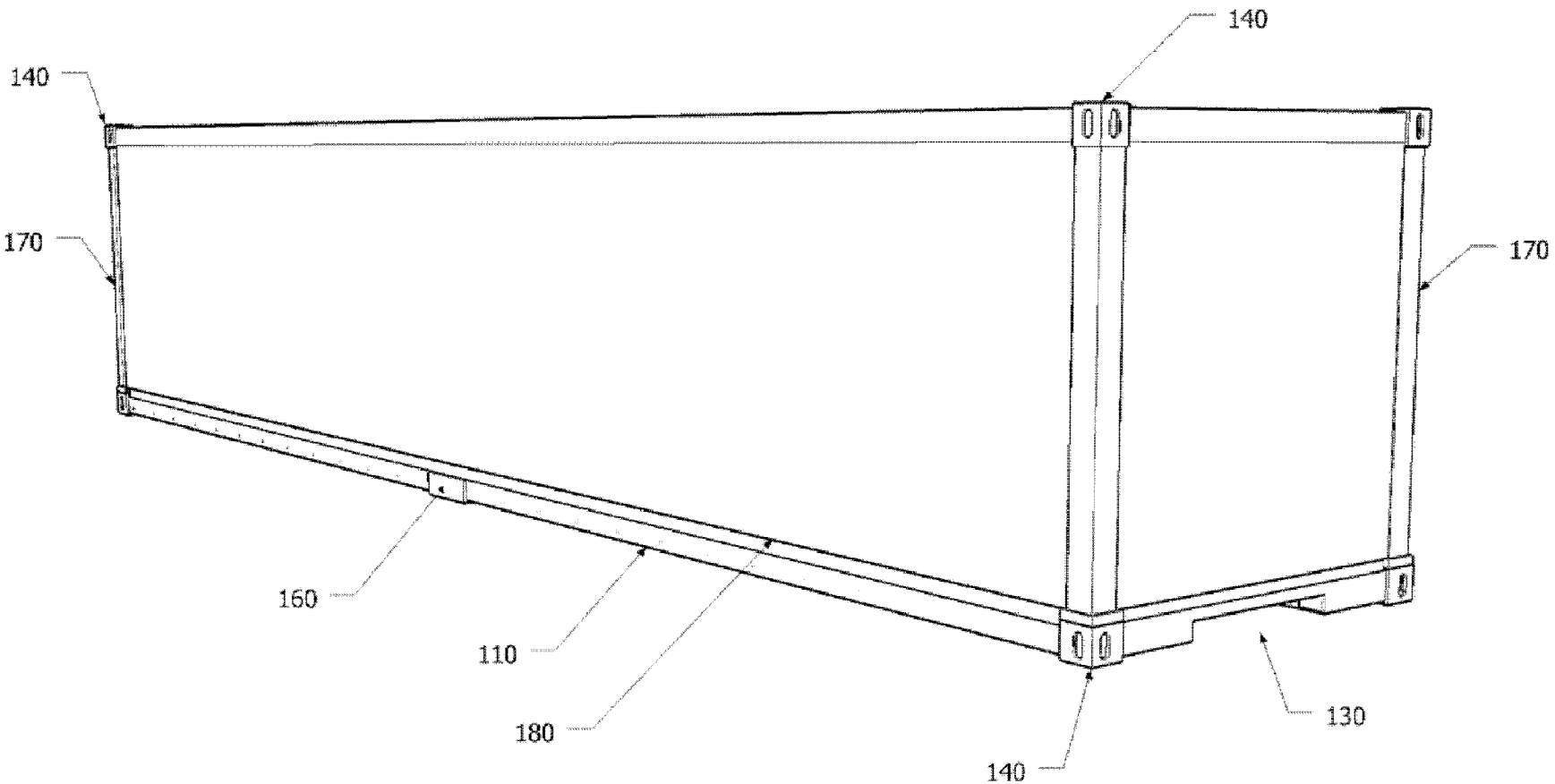
FIG. 16 provides a perspective view of a closed intermodal shipping container of the disclosure.
Figure 17:
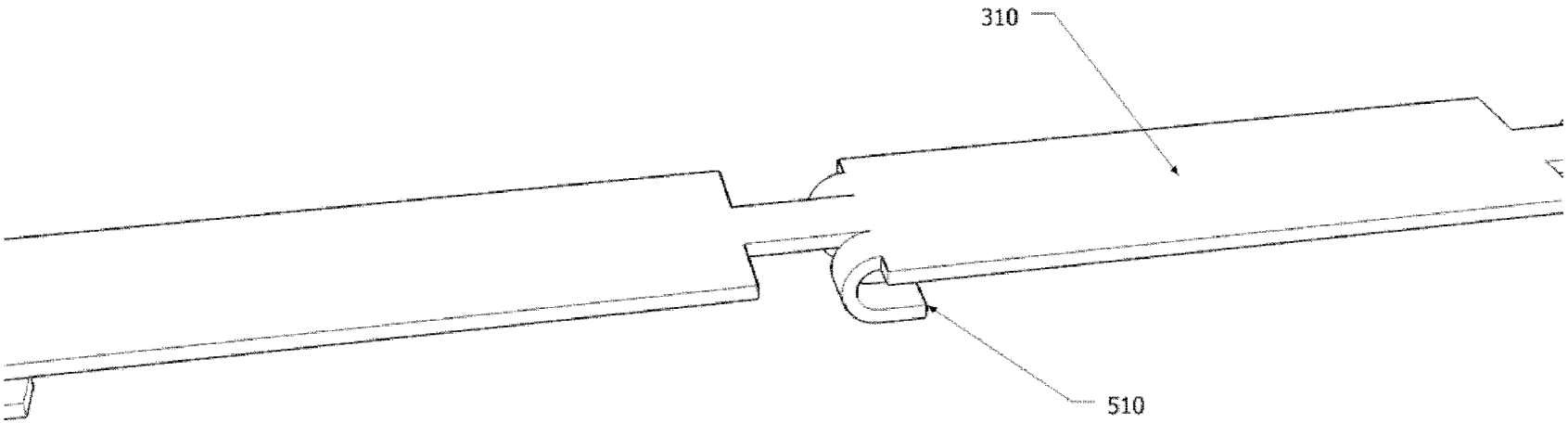
FIG. 17 depicts an exemplary slider strap.

Also visible in FIG. 9 is the slight vertical lip 910 around the perimeter of the deck or floor 240. Lip 910 provides an edge to "grab" the bottom of a pallet as it is being lowered to the deck and to hold it, precisely located, as a forklift truck driver pulls the forks from the pallet that is being loaded. Such precise location of the pallet edge helps maximize the utility of the entire deck area and minimize the likelihood of cargo protruding beyond the floor edge. This makes it easier to load pallets that extend the full 8 foot span of the cargo deck. Lip 910 is shorter than the thickness of typical pallet bottom boards and does not interfere with normal operations.

Optional center-span assembly 160 or "ISO casting" looks somewhat like the castings that were placed in the middle of conventional 40' containers so that they could be stacked on top of two common 20 ft. containers. Center-span assemblies 160 are fully functional as ISO locking points, but they also provide access to the inward ends of the sliding latch bars or side latch sections 310 and any associated locks, seals and springs. In another aspect, castings 160 are absent and the latching function is accomplished either by actuator 1910 or by manual means with conventional hand tools through a mid-span slit.

A slight, e.g., less than 2 inch, inward motion of sliding latch bars 310 pulls engagement claws 510 aside and allows latch housings 180 to be lowered into floor support frame 110. This inward motion may be accomplished with conventional hand tools or, in one embodiment, with pneumatic, hydraulic or electric power tools (not shown) that use the ISO holes to locate themselves prior to applying force on the springs.

Figure 19:
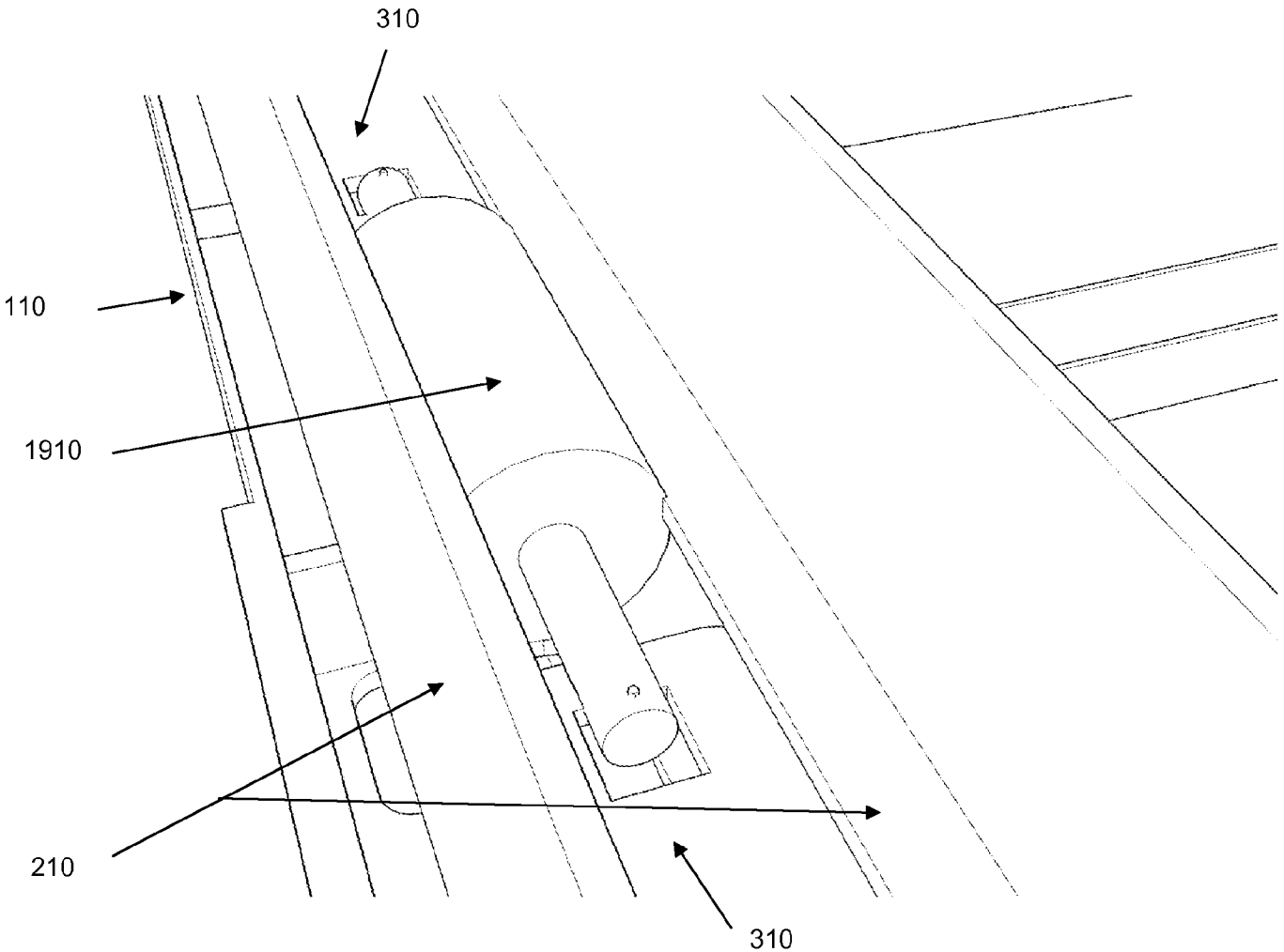
FIG. 19 illustrates an exemplary embodiment of an actuator useful to latch and unlatch the top portion to/from the floor section.
Figure 20:
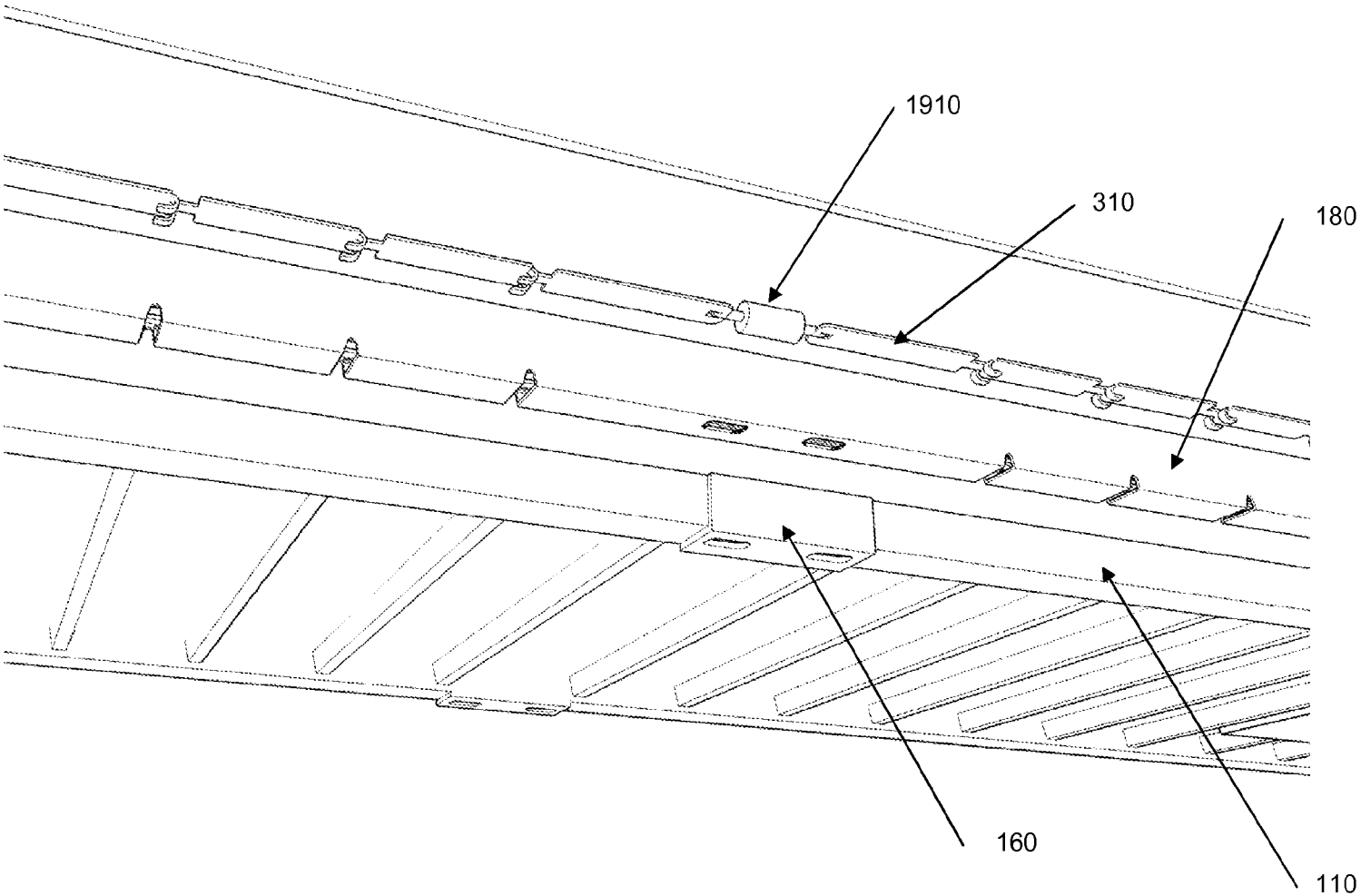
FIGS. 20-21 provide additional view of the actuator arrangement of FIG. 19.
Figure 21:
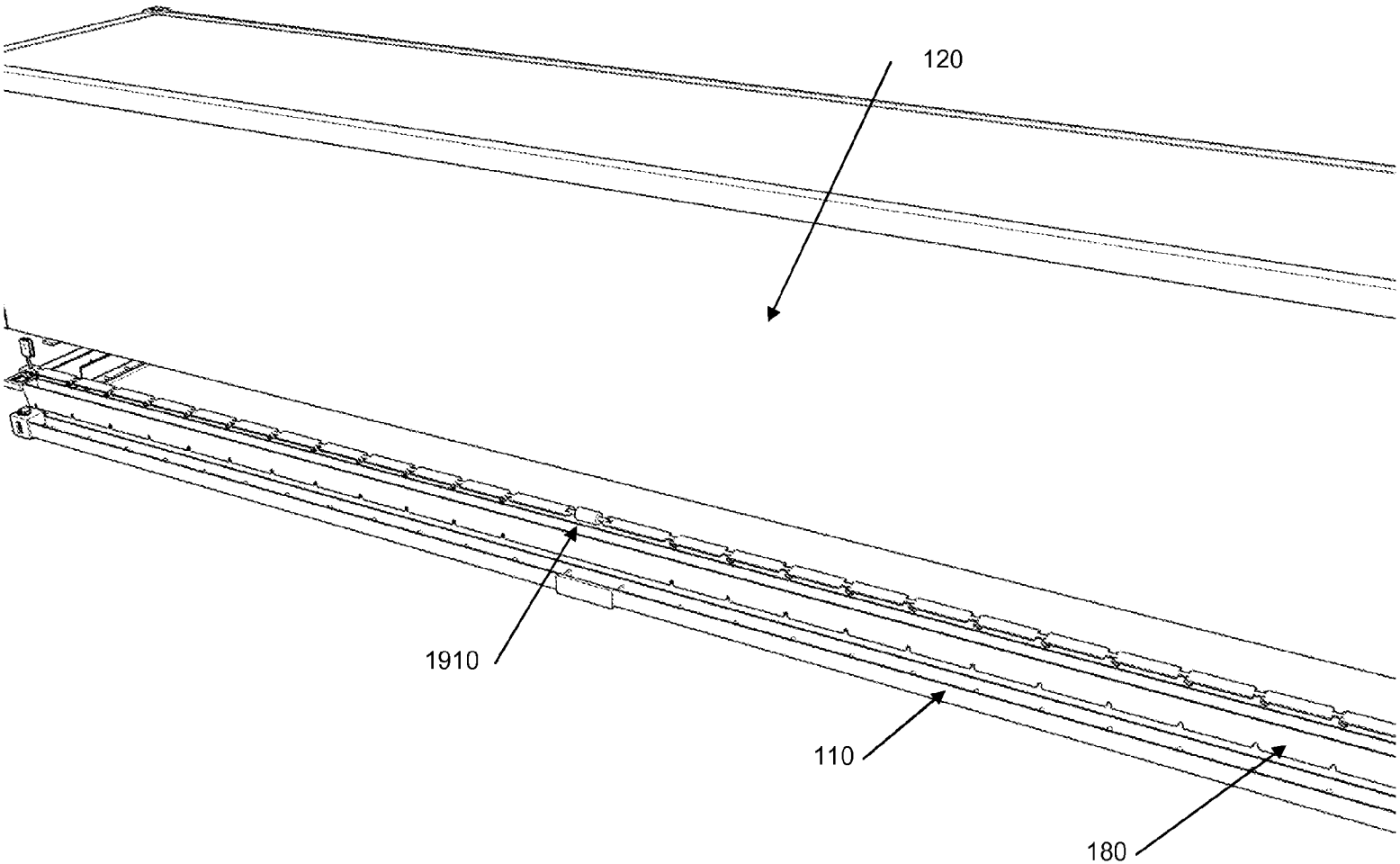

Mechanical release action may be accomplished at the middle of the container 100 by powered mechanical action. For example, and as illustrated in FIGS. 19-21, a mechanical or electromechanical latch actuator 1910 may be included to aid in latching and unlatching the various slide latch mechanisms 310. Latch actuator 1910 may be pneumatically actuated, or hydraulically actuated, or may be motor driven, as in the conventional art, all under operator control (not shown).

Spring 340 and sliding latch sections 310 comprise a relatively simple assembly. The components are easy to fabricate and assemble and the resultant function is very strong, durable and easy to maintain. No lubrication is necessary and no part that might be considered "delicate" is exposed to possible damage. The motion needed to lock and unlock the two sections is a short back and forth, straight line motion.

In terms of producing the novel container of this disclosure, all but the lower 9 inches is similar to a conventional ISO standard container design which may be reused to a great extent, including the floor and center bracing. Rungs 230 along the sides, and four of the eight rungs 250 on each end may be 1 inch in diameter, and the four rungs over the goose neck tunnel sections 130 may be approximately half that size, e.g., ½ inches in diameter, and made of a suitable material, e.g., steel.

Side latch sections 310 and end latch sections 360 may be, for example, 5/16 inch metal stock which is approximately 5 inches wide, and side latch sections 310 may be 18 ft., 9½" long on the sides. Rather than heating, cutting and forming the "C-shaped" or "J-shaped" engagement tabs 510, it may be desirable to simply weld short pieces of channel with an approximate 1 inch throat to the unmodified strap.

The corner box assemblies 140 or castings may be the same as conventional Isocontainers, except that the two inner sides have sloped surfaces 350 that push the side latch sections 310 and end latch sections 360 back as top 120 is inserted into floor support frame 110, and the top of corner block 140 has a twist lock or corner post twist lock 260 which may be rotated to "lock" corner box 140 to upper section 120.

In another embodiment, useful for certain cargo, e.g., grain or other raw foodstuffs, container 100 may be inverted so that floor support frame 110 is located at an upper position, and so that the top of canopy 120 becomes the "bottom" of container 100, this enabling the containment of grain-type or other loose cargo. The inside portion of canopy 120 may be lined with a food grade plastic liner (not shown), typically a 6 mil polyethylene sheet.

Figure 22:
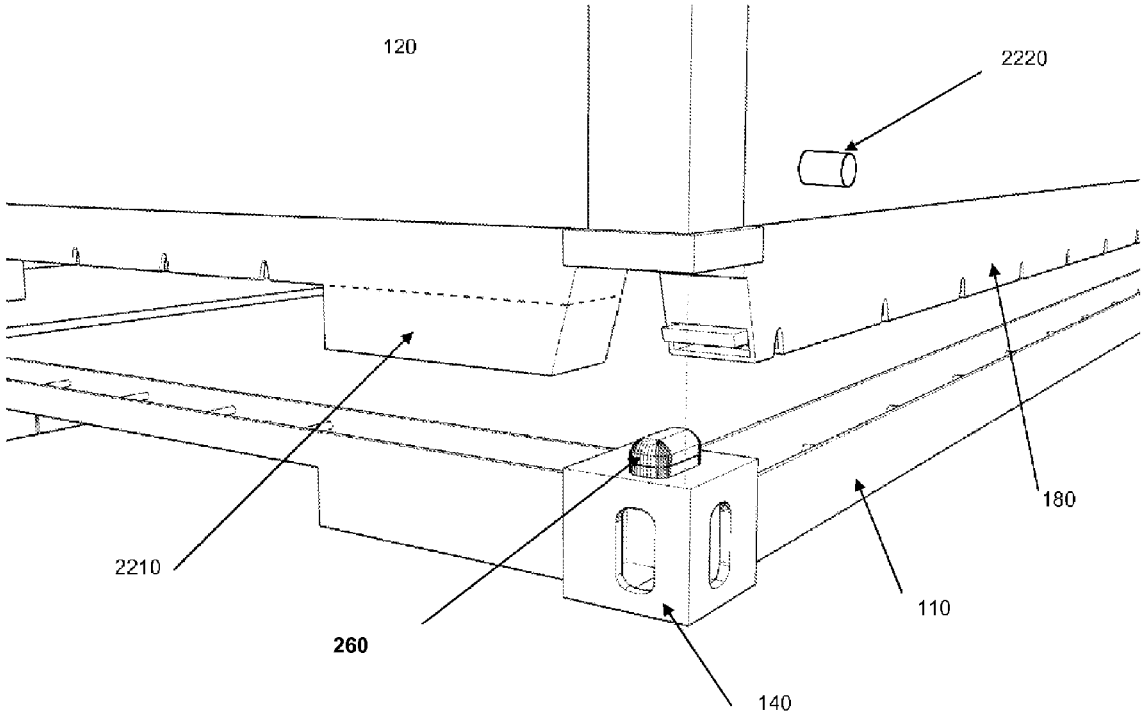
FIG. 22 provides an end view of the container illustrating a void or reserved space useful for enclosing container security mechanisms and/or electronic alarm assembly.

Further, security of container 100 may be enhanced beyond that provided by the locking features, discussed above, by use of conventional alarm devices suitably arranged in void or reserved space 2210, as illustrated in FIG. 22. Still further, a conventional Global Positioning System (GPS) transceiver (not shown) may also be enclosed in reserved space 2210 to aid in tracking of container 100 while in transit.

Optional port 2220 may be used to obtain a gas sample of the contents of container 100, in the case of the potential presence of flammable or noxious vapors in side container 100 or, in an alternative embodiment, port 2220 may be configured as a viewing port arranged to allow for viewing of the contents of container 100 from outside the container.

A method of offloading or inspecting a container of this disclosure includes the steps of decoupling the top section from the floor unit; removing the top section from the bottom section; inspecting the contents/cargo of the container by visual or instrument means (e.g., x-ray); and removing contents of the container from the side or ends of the container floor.

Conversely, cargo may be loaded into the container from the side and ends; the top section may be lowered onto the lower section or floor unit; and the top section may then be coupled onto the floor unit.

In an embodiment suitable for grain transport, the container top (lined with a food grade plastic sheet) may be inverted; the cargo poured into the inverted top section; and what was known as the "bottom" or "floor" unit may be coupled to the inverted top section. Because of the presence of the ISO corner boxes, the container of this disclosure may be shipped either in a "normal" or an "inverted" orientation.

LIST OF REFERENCE NUMBERS

| No. | Name | FIGS. |
|---|---|---|
| 100 | Intermodal shipping container | 1, 2, 16 |
| 110 | Floor support frame | 1, 2, 3, 4, 7, 8, 10, 12, 13, 14, 15, 16, 19, 20, 21, 22 |
| 120 | Upper section or canopy | 1, 2, 3, 4, 7, 16, 21, 22 |
| 130 | Gooseneck area or "tunnel" | 1, 2, 3, 4, 7, 8, 12, 13, 14, 15, 16 |
| 140 | ISO corner box assembly | 1, 2, 3, 4, 7, 8, 12, 13, 15, 16, 18 |
| 150 | Separation point or plane | 1 |
| 160 | Center span assembly | 1, 2, 3, 10, 12, 13, 14, 15, 16, 20 |
| 170 | Corner column | 1, 2, 3, 4, 7, 16 |
| 180 | Latch housing | 2, 3, 4, 6, 7, 8, 9, 10, 11, 20, 21, 22 |
| 210 | Perimeter channel or "gutter" | 2, 3, 4, 8, 12, 13, 14, 15, 19 |
| 230 | Perimeter channel rungs or horizontal tubes | 2, 8, 12, 13, 14 |
| 240 | Floor or deck | 2, 3, 4, 6, 8, 9, 10, 11, 15 |
| 250 | End rungs | 2, 3, 6, 8, 912, 15 |
| 260 | Corner post twist lock | 2, 3, 4, 7, 8, 9, 11, 12, 13, 14, 15, 18, 22 |
| 310 | Side latch sections | 3, 4, 7, 8, 10, 11, 17, 19, 20 |
| 320 | Spring assembly | 3, 11 |
| 330 | Cross-bracing | 3, 10, 12, 13, 14 |
| 340 | Spring | 3, 10, 11 |
| 350 | Sloped side | 3, 4, 7, 12, 13, 15, 18 |
| 360 | End latch sections | 3, 4, 5, 6, 8, 9, 10, 11 |
| 370 | Cutout or notched section | 3, 4, 6, 7, 8 |
| 510 | Curved engagement tab or "claw" | 4, 5, 6, 9, 17 |
| 810 | Corner post hole | 8, 9 |
| 910 | Vertical lip or edge | 9, 11, 15 |
| 1010 | Access hole | 10, 13, 15, 16 |
| 1110 | Center span rung | 11 |

-continued

| No. | Name | FIGS. |
|---|---|---|
| 1810 | Block | 18 |
| 1910 | Latch actuator | 19, 20, 21 |
| 2210 | Enclosed electronics space | 22 |
| 2220 | Sampling port | 22 |

What is claimed as new and desired to be protected by Letters Patent of the United States is:

1. An intermodal cargo container, comprising:

a lid section;

a floor unit comprising a channel portion arranged around a periphery thereof, wherein the channel portion is arranged to receive a bottom edge portion of the lid section; and a sliding lock mechanism comprising a plurality of claws that simultaneously slide horizontally to engage a plurality of rungs connected to and extending across the channel portion so as to lock the lid section to the floor unit, wherein the bottom edge portion of the lid section and the channel portion are arranged to completely contain and prevent the sliding lock mechanism from being directly accessed from either inside or outside the intermodal cargo container.

2. The cargo container of claim 1, further comprising corner boxes arranged at each corner of the floor unit.

3. The cargo container of claim 1, wherein the lid section comprises a rectangular box having an open bottom portion.

4. The cargo container of claim 1, further comprising a sealing portion arranged within the channel portion, wherein the sealing portion provides a fluid-tight seal when the lid section is coupled to the floor unit.

5. The cargo container of claim 1, further comprising an actuator arranged to mechanically assist in horizontally moving the sliding lock mechanism responsive to an operator command.

6. The cargo container of claim 1, further comprising a layer of insulation on the lid section and the floor unit.

7. The cargo container of claim 1, wherein the floor unit comprises a plurality of spaced-apart members arranged to allow air to freely flow into and out of an interior portion of the cargo container.

8. The cargo container of claim 1, further comprising a plastic liner on an interior portion of the lid section suitable for storing foodstuffs therein.

9. The cargo container of claim 1, further comprising a viewing port arranged on a section of the lid section so as to allow an interior portion of the cargo container to be viewed from outside the container.

10. The cargo container of claim 1, further comprising a sampling port arranged on the lid section, wherein the sampling port is suitable for connection to a gas analyzer.

11. The cargo container of claim 1, further comprising a gooseneck portion arranged at each end of the container, wherein a bottom portion at each end of the floor unit is recessed so as to receive a corresponding gooseneck portion.

12. The cargo container of claim 1, comprising plural sliding locking mechanisms arranged along an open edge of the lid section.

13. The cargo container of claim 1, comprising an enclosed space extending below the latch housing and floor unit and containing an alarm system or a position indication system therein.

14. The cargo container of claim 1, comprising a spring assembly arranged at a corner of the floor unit so as to provide a spring tension to the sliding lock mechanism.

15. The cargo container of claim 14, wherein the spring assembly engages the sliding lock mechanism through a slot in the sliding lock mechanism.

16. The cargo container of claim 1, further comprising corner boxes arranged at each corner of the floor unit and at corners of an upper portion of the lid section.

17. An intermodal cargo container, comprising:

a lid section comprising a rectangular box having an open bottom portion:

a floor unit comprising a channel portion arranged around a periphery thereof, wherein the channel portion is arranged to receive a bottom edge portion of the lid section:

plural sliding locking mechanisms, each comprising a plurality of claws that simultaneously slide horizontally to engage a plurality of rungs connected to and extending across the channel portion so as to lock the lid section to the floor unit;

corner boxes arranged at each corner of the floor unit and at corners of an upper portion of the lid section;

a sealing portion arranged within the channel portion, wherein the sealing portion provides a fluid-tight seal when the lid section is coupled to the floor unit:

an actuator arranged to mechanically assist in moving the sliding lock mechanism responsive to an operator command:

a gooseneck portion arranged at each end of the container; and a spring assembly arranged at a corner of the floor unit so as to provide a spring tension to the sliding lock mechanism.

18. The cargo container of claim 1, wherein the lid section and floor unit are cooperatively arranged so as to allow separation therebetween and/or rejoining while in a transport-capable configuration on a vehicle.

19. The cargo container of claim 1, wherein the lid section and floor unit are cooperatively arranged so as to allow separation therebetween and/or rejoining without requiring removal of the cargo container from a transport vehicle.

20. The cargo container of claim 1, wherein, when the cargo container is configured in a closed position, the lid section and floor unit are cooperatively arranged to prevent access to the sliding lock mechanism, to prevent access to an interior portion of the cargo container and to allow separation between the lid section and the floor unit while in a transport-capable configuration.

21. The cargo container of claim 1, wherein, when the cargo container is configured in a doorless configuration, the lid section and floor unit are each arranged without a door or other opening therein such that access to an interior portion of the cargo container is precluded without separating the lid section and floor unit from each other.

* * * * *